US007170227B2

(12) United States Patent
Kim et al.

(10) Patent No.: US 7,170,227 B2
(45) Date of Patent: Jan. 30, 2007

(54) PLASMA DISPLAY PANEL HAVING ELECTRODES WITH SPECIFIC THICKNESSES

(75) Inventors: Young-mo Kim, Gyeonggi-do (KR); Gi-young Kim, Chungcheongbuk-do (KR); Seung-hyun Son, Gyeonggi-do (KR); Kyung-jun Hong, Jeollanam-do (KR)

(73) Assignee: Samsung SDI Co., Ltd., Suwon-si (KR)

( * ) Notice: Subject to any disclaimer, the term of this patent is extended or adjusted under 35 U.S.C. 154(b) by 129 days.

(21) Appl. No.: 10/770,510

(22) Filed: Feb. 4, 2004

(65) Prior Publication Data

US 2004/0155583 A1 Aug. 12, 2004

(30) Foreign Application Priority Data

Feb. 4, 2003 (KR) ..... 10-2003-0006727

(51) Int. Cl.
*H01J 17/49* (2006.01)

(52) U.S. Cl. ..... 313/582; 313/584; 313/585

(58) Field of Classification Search ..... 313/581–587; 315/169.4; 345/37, 41, 60
See application file for complete search history.

(56) References Cited

U.S. PATENT DOCUMENTS 5,736,815 A * 4/1998 Amemiya ..... 313/586
2002/0024303 A1 2/2002 Sano et al.
2002/0084750 A1 7/2002 Su et al.
2004/0043691 A1* 3/2004 Abe et al. ..... 445/24

FOREIGN PATENT DOCUMENTS

| | | | |
|---|---|---|---|
| EP | 1349135 | A1 * | 10/2003 |
| JP | 2000-188063 | A | 7/2000 |
| JP | 1 349 135 | A1 | 10/2003 |
| KR | P2001-0084668 | | 9/2001 |
| WO | 02-47054 | A1 | 6/2002 |

OTHER PUBLICATIONS

Notice to Submit Response issued by the Korean Patent Office on Dec. 20, 2004 in a corresponding application.
European Search Report mailed Aug. 7, 2006 in EP 04250601.4, Munich, Germany.
Patent Abstracts of Japan, English-language Abstract of JP 2000-188063 of Jul. 4, 2000, Nov. 17, 2000, vol. 2000, No. 10, JPO, Japan (corresponds to and att's to JP 2000-188063 above).

* cited by examiner

*Primary Examiner*—Ashok Patel
(74) *Attorney, Agent, or Firm*—Buchanan Ingersoll & Rooney PC

(57) ABSTRACT

An AC type PDP includes a front panel having a sustaining electrode and a bus electrode attached to the sustaining electrode, and a rear panel having an address electrode. The bus electrode has a thickness so as to have a predetermined opposed surface to generate opposed discharge with respect to another bus electrode which is adjacent to the bus electrode.

11 Claims, 10 Drawing Sheets

PLASMA DISPLAY PANEL HAVING ELECTRODES WITH SPECIFIC THICKNESSES

This application claims the priority of Korean Patent Application No. 2003-6727, filed on Feb. 4, 2003, in the Korean Intellectual Property Office, the disclosure of which is incorporated herein in its entirety by reference.

BACKGROUND OF THE INVENTION

1. Field of the Invention

The present invention relates to a flat panel display device, and more particularly, to a surface discharge plasma display panel (PDP) having a partial opposed discharge effect.

2. Description of the Related Art

PDPs are electronic display devices in which a gas such as Ne+Ar or Ne+Xe is injected in a sealed space formed by front and rear glass substrates and barrier ribs disposed therebetween, a discharge is generated by applying a voltage to an anode and a cathode so that an ultraviolet ray is generated to excite a phosphor film, and a visible ray is emitted and is used as a display light.

Among flat panel displays such as LCDs (liquid crystal displays), FED (field emission displays), and ELDs (electroluminescence displays), the PDP is advantageous in increasing the size of a screen.

The PDP can have a large screen because the PDP adopts a method in which electrodes and phosphor substances are appropriately provided and coated on two glass substrates, each having a thickness of 3 mm, the glass substrates are maintained with an interval of about 0.1–0.2 mm, forming a space, and plasma is formed in the space.

The PDP exhibits not only a strong non-linearity, a memory function owing to wall charges, and a theoretically long life of more than 100,000 hours, but also high brightness and high light emission efficiency. Also, the PDP has a wide view angle corresponding to CRTs (cathode ray tubes) and is capable of easily representing full color. Since the PDP uses a widely used soda-lime glass as the substrate and cheap materials for the electrode, a dielectric film, and the barrier rib, when a mass production technology is established, mass production at a low cost is possible.

In addition, the PDP has heat-resistant and cold-resistant features because the plasma generated in each pixel of the PDP is hardly affected when the temperature of the barrier rib or electrode is between −100° C. through 100° C. The PDP can be made light, has a superior aseismatic feature because it does not use a filament unlike CRTs or VFDs (vacuum fluorescent displays), and has no possibility of internal explosion unlike the CRTs. Further, the PDP is capable of representing a high resolution image according to the density of plasma.

In the meantime, since pulses having a voltage of 150–200 V and a frequency of 70–80 kHz is used to drive the PDP, the PDP requires a high voltage resistant drive IC.

Since the high voltage resistant drive IC is expensive, the high voltage resistant drive IC takes a great portion in the total price of a PDP panel. Thus, it is needed to lower both the drive voltage and the cost for the drive IC through improvement of a driving method.

FIG. 1 is a perspective vie illustrating a conventional AC type PDP having the above features. Referring to FIG. 1, the conventional PDP includes a front glass substrate 10 and a rear glass substrate 12 parallel to the front glass substrate 10. First and second transparent sustaining electrodes 14*a* and 14*b* are arranged, parallel to each other, on a surface of the front glass substrate 10 facing the rear glass substrate 12. The first and second sustaining electrodes 14*a* and 14*b* are separated by a gap d as shown in FIG. 2. First and second bus electrodes 16*a* and 16*b* are provided on the first and second sustaining electrodes 14*a* and 14*b* to be parallel to the first and second sustaining electrodes 14*a* and 14*b*. The first and second bus electrodes 16*a* and 16*b* prevent a voltage drop due to resistance during discharge. The first and second sustaining electrodes 14*a* and 14*b* and the first and second bus electrodes 16*a* and 16*b* are covered with a first dielectric layer 18. The first dielectric layer 18 is covered with a protection film 20. The protection film 20 protects the first dielectric layer 18, which has a reduced durability due to the discharge, so that the PDP can be stably operated for a long time. Also, the protection film 20 lowers a discharge voltage during the discharge by emitting a large amount of secondary electrons. A magnesium oxide (MgO) film is widely used as the protection film 20.

A plurality of address electrodes 22 used for writing data are formed on the rear glass substrate 12. The address electrodes 22 are all arranged parallel to one another, but perpendicularly to the first and second sustaining electrodes 14*a* and 14*b*. The address electrodes 22 are provided by three per pixel. In one pixel, the three address electrodes 22 respectively correspond to a red phosphor, a green phosphor, and a blue phosphor. A second dielectric layer 24 covering the address electrodes 22 is formed on and above the rear glass substrate 12. A plurality of barrier ribs 26 are provided on the second dielectric layer 24. The barrier ribs 26 are separated by a predetermined distance and parallel to the address electrodes 22. The barrier ribs 26 are positioned on the second dielectric layer 24 between the address electrodes 22. That is, the address electrodes 22 and the barrier ribs 26 are alternately arranged. The barrier ribs 26 closely contact the protection film 20 of the front glass substrate 10 when the barrier ribs 26 are attached to the front and rear glass substrates 10 and 12. First, second, and third phosphor substances 28*a*, 28*b*, and 28*c* are coated between the respective barrier ribs 26. By being excited by an ultraviolet ray, the first phosphor substance 28*a* emits a red R ray, the second phosphor substance 28*b* emits a green G ray, and the third phosphor substance 28*c* emits a blue B ray.

After the front and rear glass substrates 10 and 12 are combined forming a seal, unnecessary gases are exhausted between the two glass substrates 10 and 12 and then a gas for generating plasma is injected. A single gas, such as neon (Ne), may be used as the plasma generating gas. However, a mixed gas, such as Ne+Xe, is widely used as the plasma generating gas.

According to the conventional PDP, a large screen and a wide view angle are possible. However, since the brightness and efficiency of the PDP are lower than those of the CRT, a higher consumption power is needed to improve the disadvantages. Since the increase in the consumption power means high voltage driving, a drive IC having a superior high voltage resistance feature is required. Consequently, the price of PDP is raised together with an increase in the power consumption.

SUMMARY OF THE INVENTION

To solve the above and/or other problems, embodiments of the present invention provides a PDP in which brightness and efficiency are improved without increasing the consumption power and a discharge initiation voltage is lowered.

According to an aspect of the present invention, an AC type PDP includes a front panel having a sustaining electrode and a bus electrode attached to the sustaining electrode and a rear panel having an address electrode, wherein the bus electrode has a thickness so as to have a predetermined opposed surface to generate opposed discharge with respect to another bus electrode which is adjacent to the bus electrode.

The other bus electrode has a thickness so as to have the same opposed surface as that of the bus electrode. Preferably, the thickness is at least 14 μm.

The thickness of the other bus electrode is thinner than that of the bus electrode.

The address electrode has the same thickness as that of the bus electrode.

A dielectric film and a protection film covering the sustaining electrode and the bus electrode are provided on and above the front panel and a portion of the dielectric firm and the protection film where the bus electrode is formed is bulged toward the rear panel.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
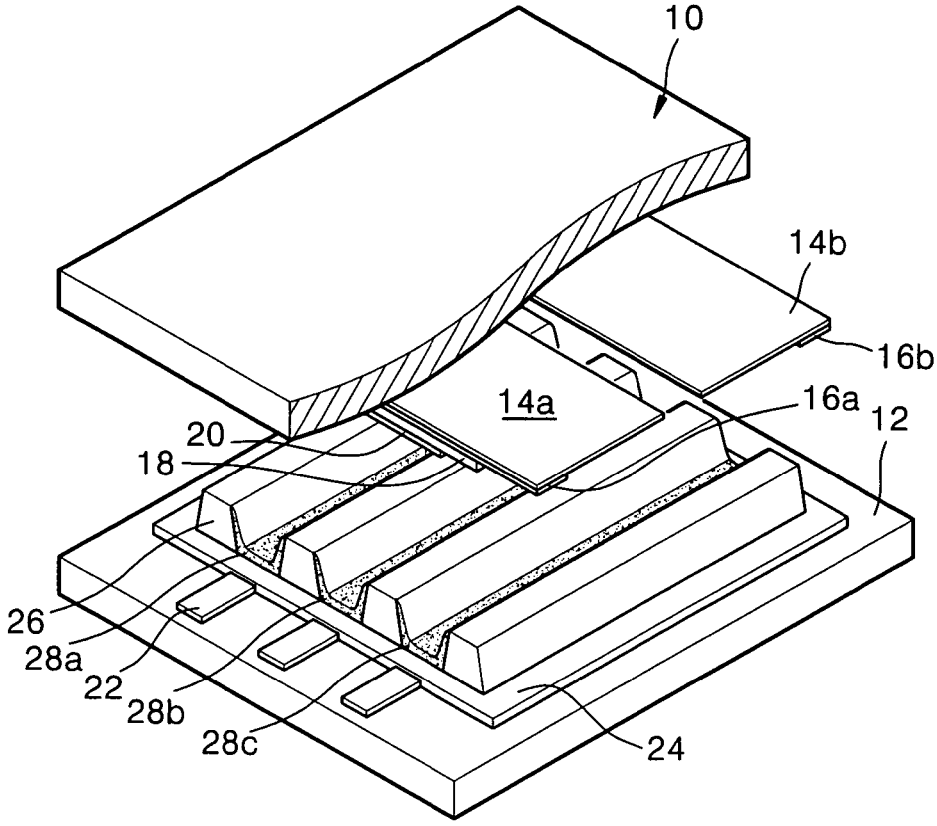
FIG. 1 (PRIOR ART)
FIG. 1 is a perspective view illustrating a conventional AC type plasma display panel.

A PDP according to an exemplary embodiment of the present invention will now be described with reference to the accompanying drawings. In the drawings, the thicknesses of layers or regions are exaggerated for the convenience of explanation.

Figure 3:
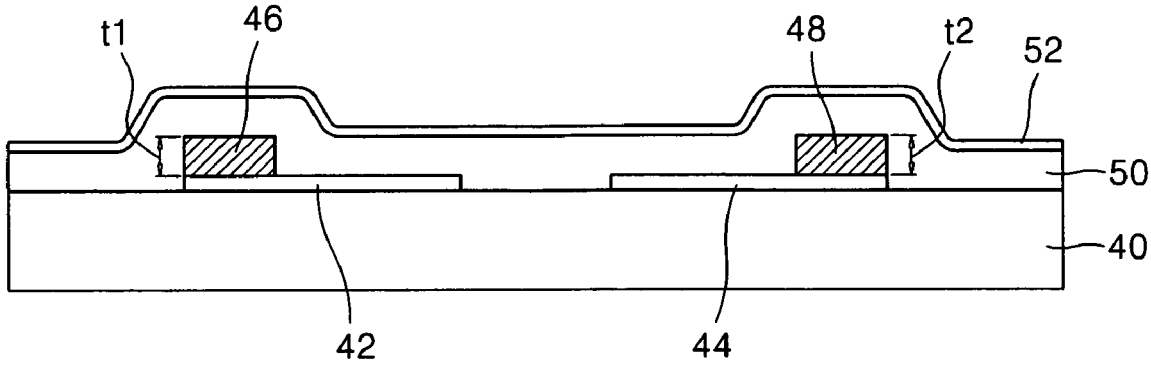
FIG. 3 is a sectional view illustrating a front panel forming an AC type PDP according to an exemplary embodiment of the present invention.

FIG. 3 is a sectional view illustrating a front panel area of the PDP according to the preferred embodiment of the present invention. In order to help the convenience of illustration and the understanding of the present invention, a portion of a front panel facing a rear panel is illustrated to be disposed on a front glass substrate.

Figure 2:
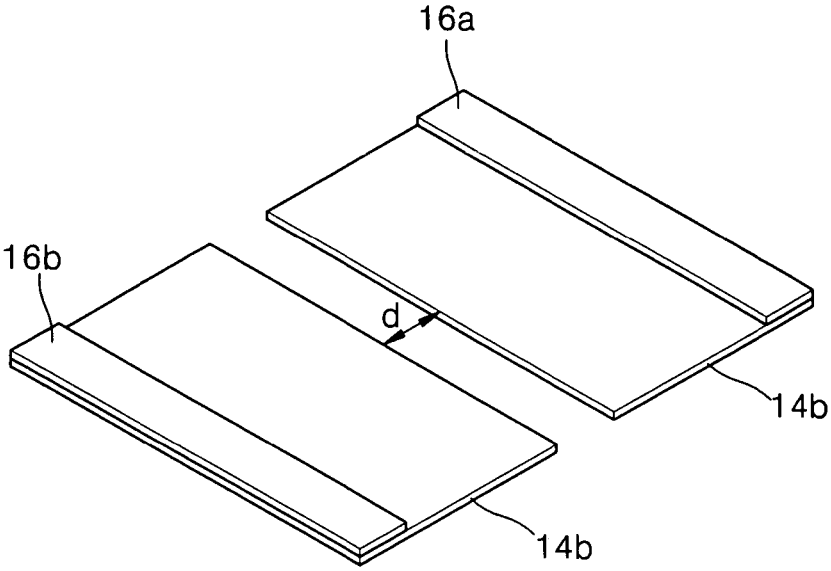
FIG. 2 (PRIOR ART)
FIG. 2 is a perspective view illustrating sustaining electrodes and bus electrodes only in the plasma display panel shown in FIG. 1.

Referring to FIG. 3, first and second sustaining electrodes 42 and 44 are arranged in strips and parallel to each other on a front glass substrate 40. The first and second sustaining electrodes 42 and 44 are separated a predetermined distance suitable for discharge from each other. A positive (+) voltage for initiating discharge is applied to one of the first and second sustaining electrodes 42 and 44 and a negative (−) voltage is applied to the other sustaining electrode. First and second bus electrodes 46 and 48 are formed in strips and parallel to each other on the first and second sustaining electrodes 42 and 44, respectively. The first and second bus electrodes 46 and 48 are made of silver Ag and have first and second thicknesses t1 and t2, respectively. The thicknesses t1 and t2 are much thicker than not only those of the conventional bus electrodes 16*a* and 16*b* of FIG. 2 but also those of the first and second sustaining electrodes 42 and 44. Preferably, the first and second thicknesses t1 and t2 of the first and second bus electrodes 46 and 48 are identical and moreover the first and second bus electrodes 46 and 48 are thick so as to have surfaces facing each other, for example, 14 μm or more.

The first and second bus electrodes 46 and 48 are formed on the first and second sustaining electrodes 42 and 44 in a predetermined method, for example, a thick film print method. The first and second bus electrodes 42 and 44 have the first and second thicknesses t1 and t2 by printing a thin film having a conductivity much higher than that of the first and second sustaining electrodes 42 and 44, for example, a silver thin film, on the first and second sustaining electrodes 42 and 44 at least three times using the thick film print method.

Since the first and second bus electrodes 46 and 48 are thick enough to have the opposed surfaces, surface discharge is generated between the first and second sustaining electrodes 42 and 44 and simultaneously opposed discharge is generated between the first and second bus electrodes 46 and 48, although the amount of the opposed discharge is smaller than the surface discharge between the first and second bus electrodes 46 and 48.

Since the first and second bus electrodes 44 and 46 are used for discharge in the form of an opposed discharge, the efficiency in discharge of an electrode group made up of the first sustaining electrode 42 and the first bus electrode 46 and an electrode group made up of the second sustaining electrode 44 and the second bus electrode 48 is increased much higher, compared to the conventional technology. The increase in the discharge efficiency results in an increase in the brightness and efficiency of a PDP.

Referring to FIG. 3, the dielectric film 50 and the protection film 52 covering the first and second sustaining electrodes 42 and 44 and the first and second bus electrodes 46 and 48 are sequentially formed on and above the front glass substrate 40. The protection film 52 is an MgO film. The dielectric film 50 and the protection film 52 protrude as much as the first and second thicknesses t1 and t2 of the first and second bus electrodes 46 and 48 at portions where the first and second bus electrodes 46 and 48 are formed, due to the thicknesses of the first and second bus electrodes 46 and 48. In the PDP, since the first panel having the first and second bus electrodes 46 and 48 is opposed to the rear panel, the interval between the dielectric film 50 and the protection film 52 and the rear panel at the portions where the first and second bus electrodes 46 and 48 are provided is decreased as much as the first and second thicknesses t1 and t2 of the first and second bus electrodes 46 and 48, compared to the dielectric film 50 and the protection film 52 formed at the other portion.

Figure 4:
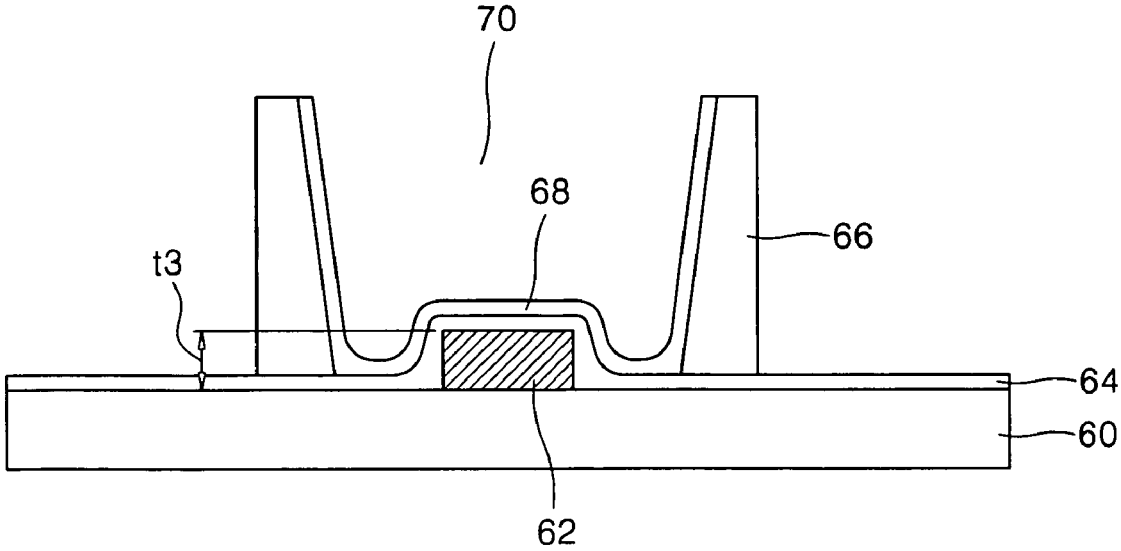
FIG. 4 is a sectional view illustrating a rear panel forming the AC type PDP according to an exemplarv embodiment of the present invention and facing the front panel of FIG. 3.

FIG. 4 shows a section of the rear panel opposed to the front panel shown in FIG. 3 in a direction perpendicular to an address electrode 62. Referring to FIG. 4, The address electrode 62 is formed perpendicularly to the first and second sustaining electrodes 42 and 44 and the first and second bus electrodes 46 and 48. A third thickness t3 of the address electrode 62 is at least 14 μm which is much thicker than the address electrode 22 of FIG. 1 of the conventional PDP. Accordingly, a step corresponding to the third thickness t3 is formed between a region where the address electrode 62 of the rear glass substrate 60 exists and a region where the address electrode 62 of the rear glass substrate 60 does not exist. A dielectric film 64 having a predetermined thickness and covering the address electrode 62 is formed on and above the rear glass substrate 60. The dielectric film 64 is thinner than the third thickness t3 of the address electrode 62. Thus, after the dielectric film 64 is formed, the step formed due to the address electrode 62 remains. Barrier ribs 66 are formed on the dielectric film 64 at the opposite sides with respect to the address electrode 62. The barrier ribs 66 are symmetrical with respect to the address electrode 62 and parallel to the address electrode 62. A phosphor layer 68 is coated on the entire surface of the dielectric film 64 and the entire surfaces of the barrier ribs 66 facing each other. An inner space surrounded by the phosphor layer 68 is a region where plasma is generated. Since the address electrode 62 has the third thickness t3, the step due to the address electrode 62 is left after the phosphor layer 68 is formed. Since the third thickness t3 of the address electrode 62 is much greater than that of the conventional address electrode 22 of FIG. 1, the phosphor layer 68 formed above the address electrode 62 protrudes much higher than that of the conventional technology. Consequently, the interval between the address electrode 62 and the first and second sustaining electrodes 42 and 44 of the front panel is decreased by far, compared to the conventional technology.

In the front panel shown in FIG. 3, the first and second thicknesses t1 and t2 of the first and second bus electrodes 46 and 48 are preferably the same. However, it is possible that the first and second thicknesses t1 and t2 of the first and second bus electrodes 46 and 48 are different from each other.

Figure 5:
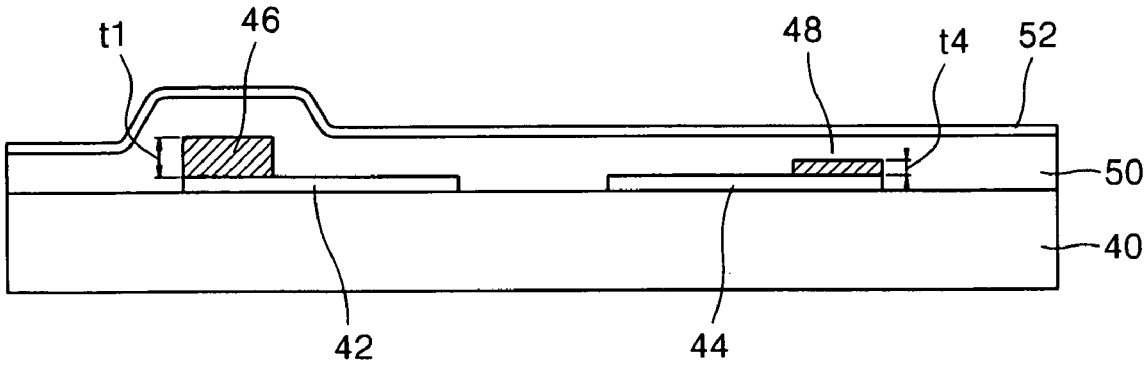
FIGS. 5 and 6 are sectional views showing cases in which the thicknesses of two sustaining electrodes provided on the front panel shown in FIG. 3 are different.
Figure 6:
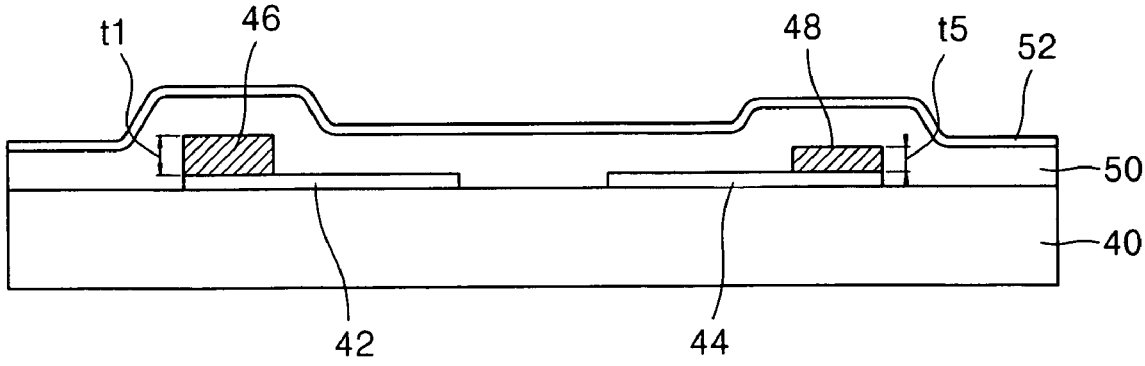

FIGS. 5 and 6 show examples in which the first and second bus electrodes 46 and 48 have different thicknesses. In FIG. 5, the first bus electrode 46 has the first thickness t1 which is much thicker than the conventional bus electrode while the second bus electrode 48 has a fourth thickness t4 which is the same as the conventional bus electrode. In FIG. 6, the second bus electrode 48 has a fifth thickness t5 which is an intermediary thickness, that is, a thickness thinner than the first thickness t1 of the first bus electrode t1 but thicker than the fourth thickness t4 shown in FIG. 5.

Figure 7:
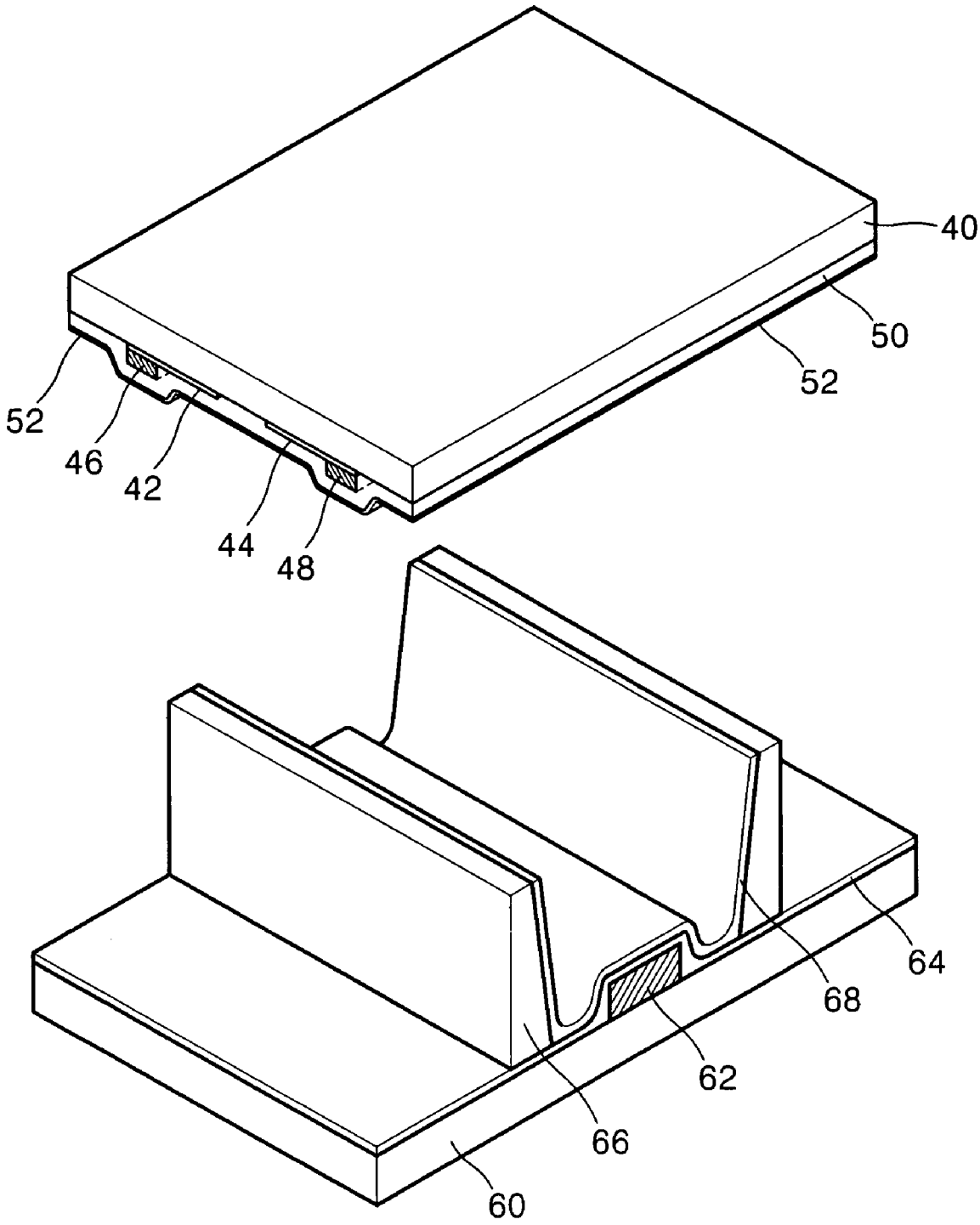
FIG. 7 is an exploded perspective view illustrating the AC type PDP according to an exemplary embodiment of the present invention having the front and rear panels shown in FIGS. 3 and 4.
Figure 8:
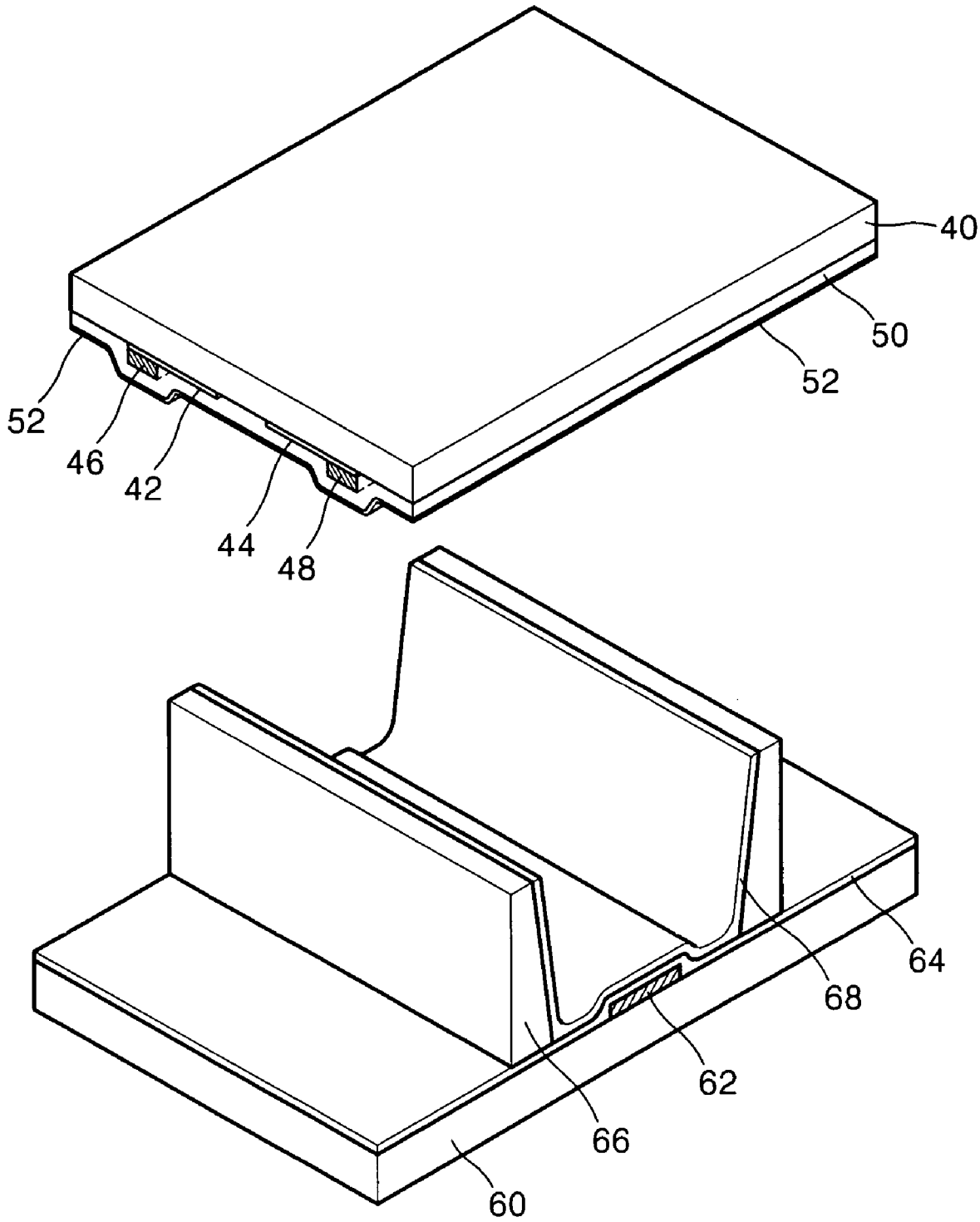
FIGS. 8 through 11 are exploded perspective views illustrating modified examples of the AC type PDP shown in FIG. 7.
Figure 9:
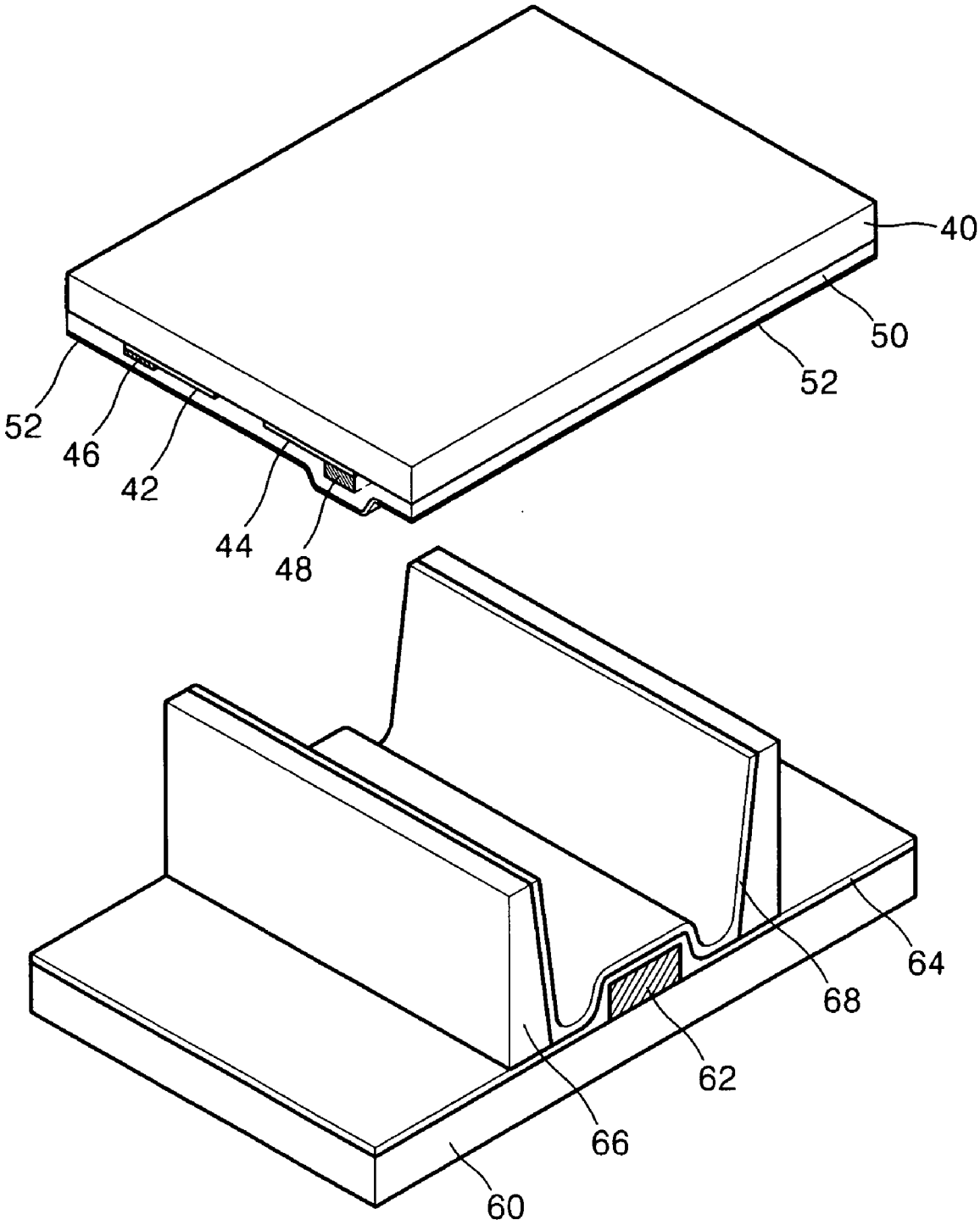
Figure 10:
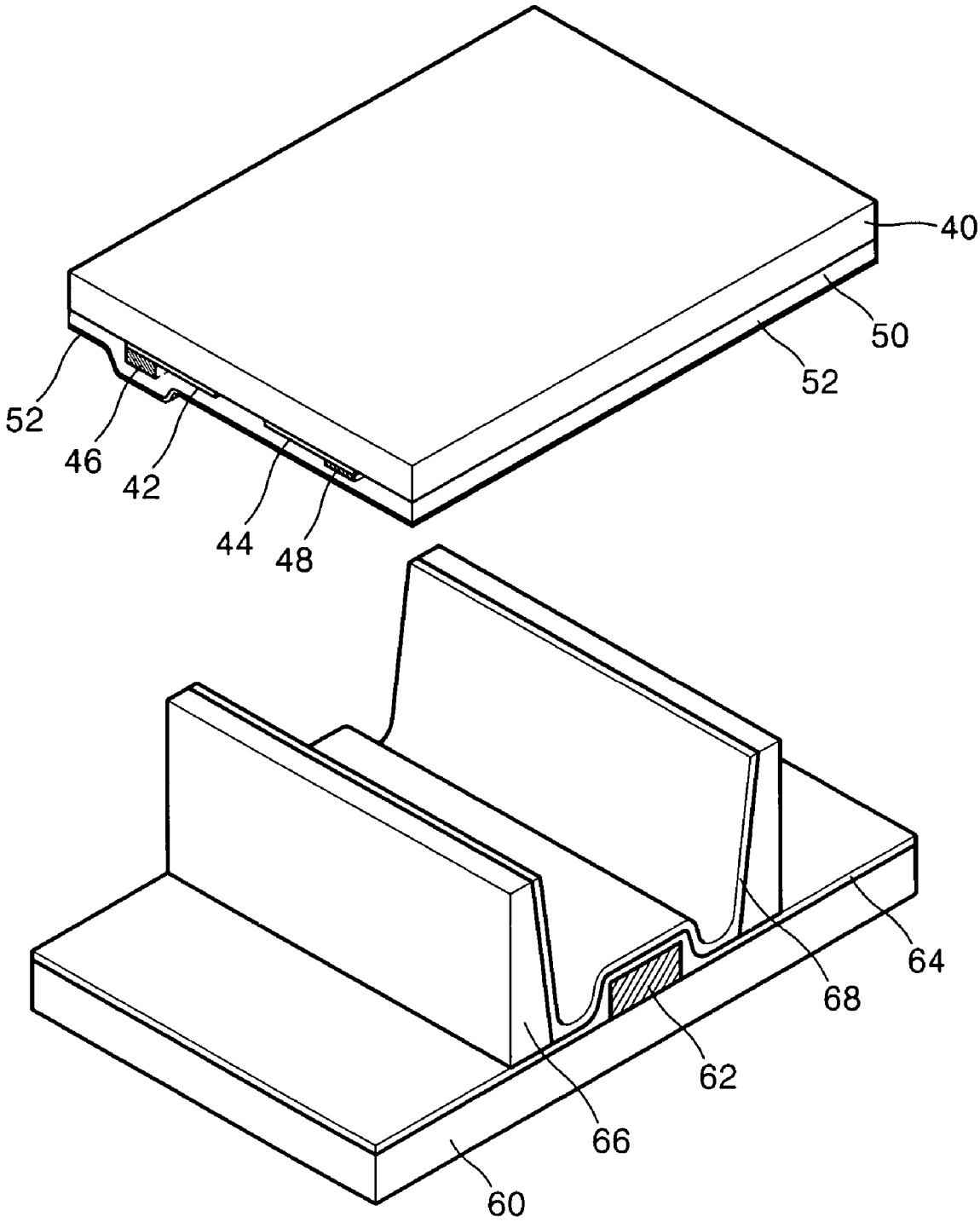
Figure 11:
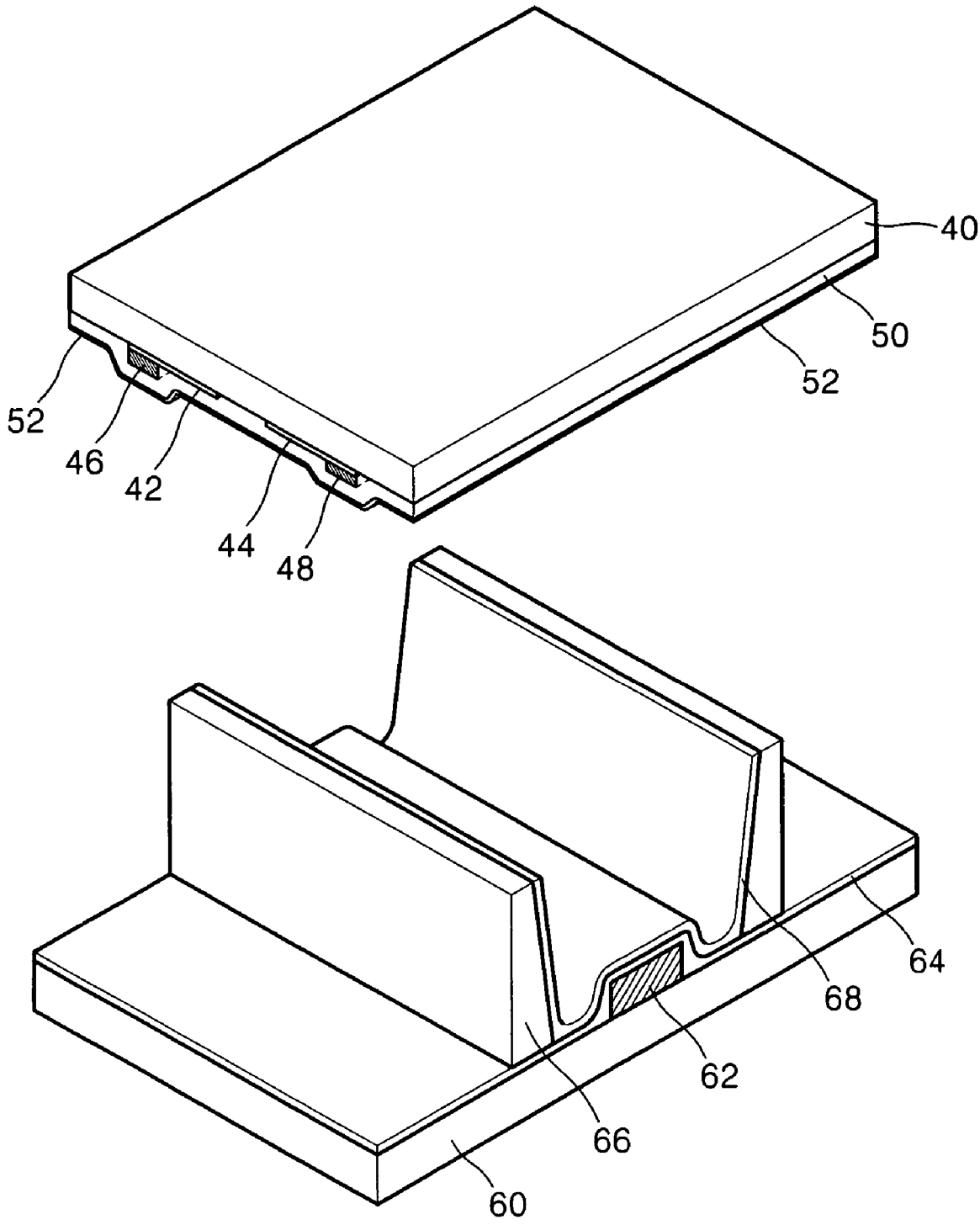

FIGS. 7 through 11 show PDPs which are made up of the above-described front and rear panels. In FIG. 7, the PDP includes the front panel shown in FIG. 3 in which the first and second bus electrodes 46 and 48 have the first and second thicknesses t1 and t2 and the rear panel shown in FIG. 4 in which the address electrode 62 has the third thickness t3. In FIG. 8, the PDP includes the front panel shown in FIG. 3 in which the first and second bus electrodes 46 and 48 have the first and second thicknesses t1 and t2 and the rear panel in which the address electrode 62 has the same thickness as that of the conventional address electrode. FIGS. 9 and 10 show a case in which the first bus electrode 46 has the same thickness as that of the conventional bus electrode in the PDP shown in FIG. 7 and a case in which the second bus electrode 48 has the same thickness as that of the conventional bus electrode in the PDP shown in FIG. 7, respectively. In FIG. 11, in the PDP shown in FIG. 7, the second bus electrode 48 has the fifth thickness t5 which is an intermediary thickness as shown in FIG. 6.

Figure 12:
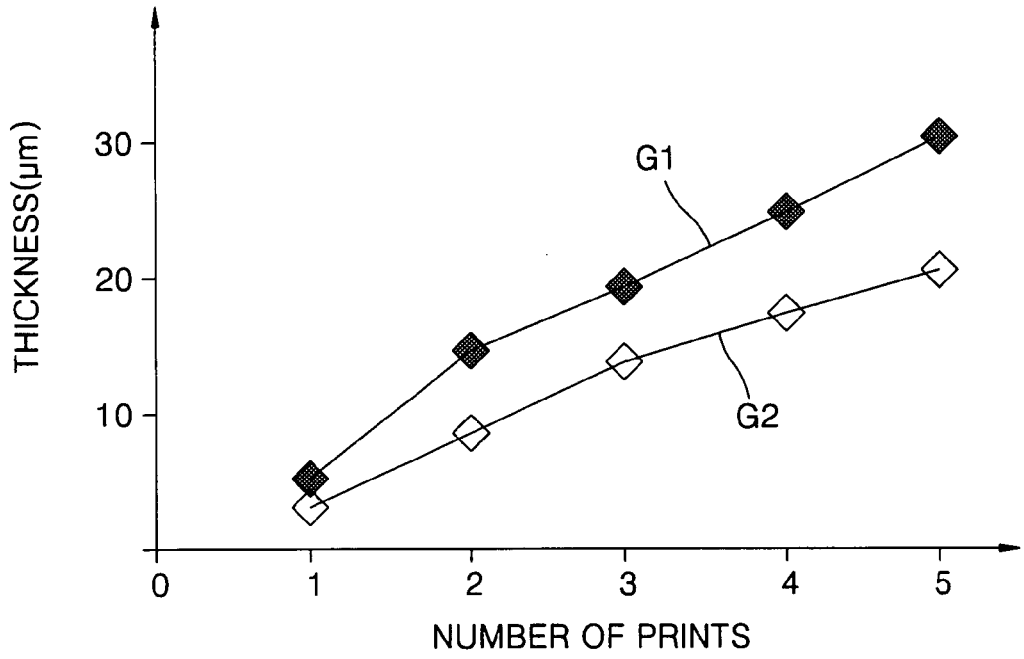
FIGS. 12 through 14 are graphs showing the results of tests performed with respect to the AC type PDP shown in FIG. 7.
Figure 13:
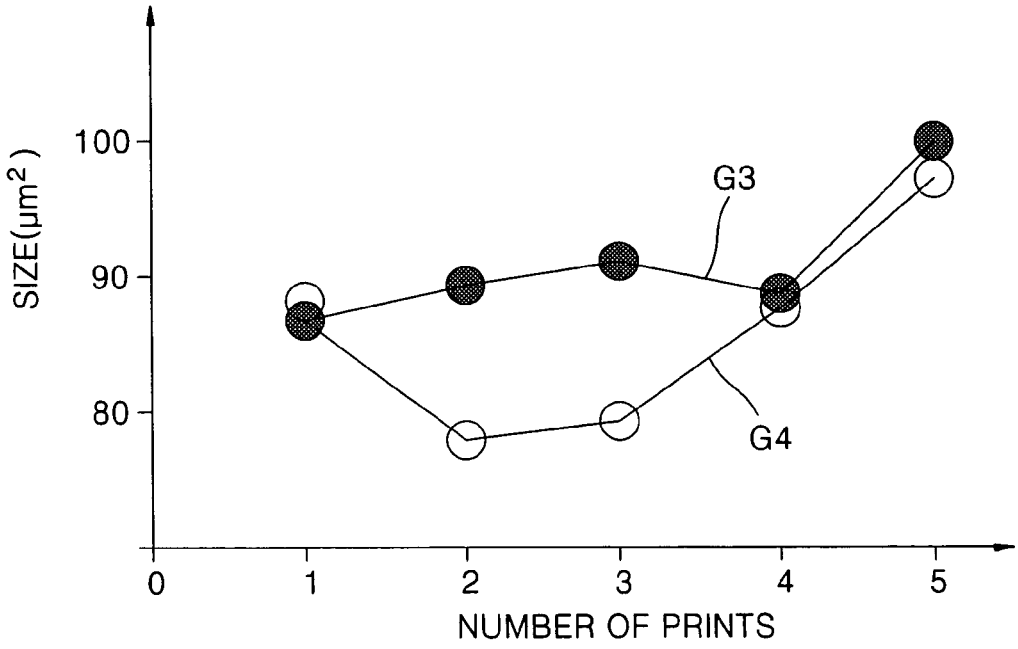

FIGS. 12 and 13 are graphs showing changes in the thickness and size of the first and second bus electrodes 46 and 48 according to the number of prints in the process of forming the first and second bus electrodes 46 and 48 in the thick film print method, by classifying the changes into states before and after firing. In FIG. 12, reference numerals G1 and G2 are first and second graphs, respectively, indicating changes in the thickness of the first and second bus electrodes 46 and 48 measured before and after firing. Referring to the first and second graphs G1 and G2 of FIG. 12, it can be seen that the thicknesses of the first and second bus electrodes 46 and 48 increase in proportional to the number of prints and that the thicknesses are slightly decreased after firing.

Actually, the thickness of the first and second bus electrodes 46 and 48 can be formed up to 60 μm before firing. However, the thickness is decreased to 50 μm after firing.

In FIG. 13, reference numerals G3 and G4 are third and fourth graphs, respectively, indicating changes in the size of the first and second bus electrodes 46 and 48, before and after firing, according to the number of prints. Referring to the third and fourth graphs G3 and G4 of FIG. 13, it can be seen that, when the number of prints exceeds over three times, the size hardly changes either before firing or after firing.

Figure 14:
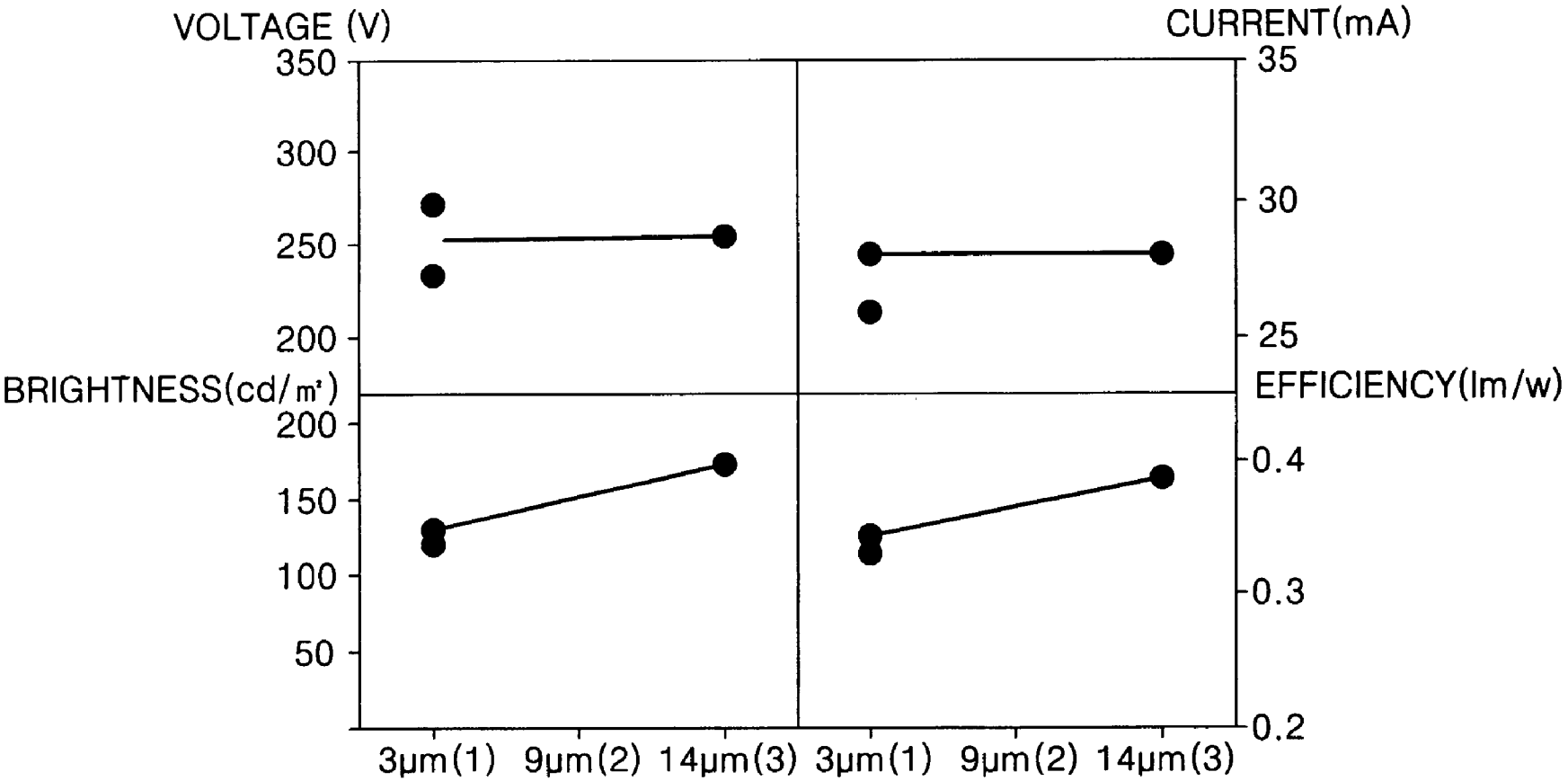

FIG. 14 is a graph for explaining the brightness and light emitting efficiency feature of the PDP according to the preferred embodiment of the present invention. When the thicknesses of the first and second bus electrodes 46 and 48 are 3 μm as in the conventional bus electrode, the brightness is about 125 cd/$m^2$. When the thickness is 14 μm, the brightness approaches 200 cd/$m^2$. Therefore, for the PDP according to the present invention, the brightness can be improved by 40% or more.

Also, it can be seen that the light emitting efficiency can be improved by 20% or more. When the thicknesses of the first and second bus electrodes 46 and 48 are 3 μm, the light emitting efficiency is in the middle between 0.3 Im/W and 0.4 Im/W. When the thickness becomes 14 μm by performing prints over three times, the light emitting efficiency approaches 0.4 Im/W.

Even through the brightness and light emitting efficiency are increased as the thicknesses of the first and second bus electrodes 46 and 48 increase, the voltage needed for discharge is about 250 V which is hardly changed according to the change in thickness of the first and second bus electrodes 46 and 48 and the current is constant at about 20 mA.

In the meantime, although not shown in the drawings, the brightness and efficiency feature as shown in FIG. 14 remain after a PDP stabilization step, that is, an aging step, is performed after the PDP is completed by combining the front and rear panels.

As described above, in the AC type PDP according to the present invention, since the bus electrodes have thicknesses sufficient to generate the opposed discharge, while the surface discharge which is a main discharge is performed by the sustaining electrodes, the opposed discharge which is an auxiliary discharge is performed by the bus electrodes. Also, the thickness of the address electrodes provided on the rear panel is further increased, if necessary, compared to the conventional technology. Thus, when the PDP according to the present invention is used, although the main discharge is the surface discharge, since the discharge is partially generated by the opposed discharge, both the brightness and light emitting efficiency are improved without additional power consumption and the discharge initiation voltage is lowered.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An alternating current-type plasma display panel (PDP), comprising:

a first panel having address electrodes oriented in one direction;

a second panel having pairs of sustaining electrodes oriented in a direction substantially perpendicular to said address electrodes, and pairs of bus electrodes respectively attached in parallel to said pairs of sustaining electrodes; and a phosphor layer between said sustaining electrodes and said address electrodes in the space between said first and second panels, wherein at least one of said bus electrodes is a thick bus electrode having a thickness of at least 6 μm and positioned such that a side face of said thick bus electrode is opposite to and facing another bus electrode of at least one bus electrode pair, wherein a discharge is generated between the thick bus electrode and said other bus electrode of said at least one bus electrode pair.

2. The PDP as claimed in claim 1, wherein said other bus electrode has a thickness of 14 μm.

3. The PDP as claimed in claim 1, wherein the thickness of said other bus electrode is thinner than that of said thick bus electrode.

4. The PDP as claimed in claim 1, wherein said other bus electrode and said thick bus electrode are of the same thickness.

5. The PDP as claimed in claim 1, wherein at least one address electrode has the same thickness as that of the thick bus electrode.

6. The POP as claimed in claim 3, wherein at least one address electrode has the same thickness as that of the thick bus electrode.

7. The PDP as claimed in claim 1, further comprising a dielectric film and a protection film covering said pairs of sustaining electrodes and said pairs of bus electrodes such that a portion of the dielectric film and the protection film where the beus electrode is formed bulges towards the second panel.

8. The PDP as claimed in claim 1, wherein the thickness of the thick bus electrode is between 14 μm and 50 μm.

9. The POP as claimed in claim 1, wherein the thick bus electrode has a thickness greater than 14 μm.

10. The POP as claimed in claim 1, wherein the thickness of the thick bus electrode and the other bus electrode is between 14 μm and 50 μm.

11. The PDP as claimed in claim 1, wherein the thick bus electrode and the other bus electrode is greater than 14 μm.

* * * * *